United States Patent [19]

Shames

[11] 4,020,570

[45] May 3, 1977

[54] CUSHIONED INSOLE FOR FOOTWEAR SUCH AS SHOES, BOOTS, OR THE LIKE

[75] Inventor: Jerry Shames, New York, N.Y.

[73] Assignee: Hiraoka New York, Inc., New York, N.Y.

[22] Filed: Oct. 10, 1975

[21] Appl. No.: 621,300

[52] U.S. Cl. ..... 36/44

[51] Int. Cl.[2] ..... A43B 13/38

[58] Field of Search ..... 36/43, 44, 11.5

[56] References Cited

UNITED STATES PATENTS

| | | | |
|---|---|---|---|
| 1,867,679 | 7/1932 | Riehle et al. | 36/11.5 X |
| 1,953,048 | 3/1934 | Crompton | 36/44 X |
| 2,008,207 | 7/1935 | Greenberg | 36/43 X |
| 2,184,456 | 12/1939 | Knapp | 36/44 X |
| 3,468,040 | 9/1969 | Fukuoka | 36/11.5 |
| 3,530,489 | 9/1970 | Appleton | 36/44 |
| 3,785,068 | 1/1974 | Bretschneider | 36/11.5 |

FOREIGN PATENTS OR APPLICATIONS

| | | | |
|---|---|---|---|
| 61,951 | 6/1968 | Germany | 36/43 |

*Primary Examiner*—Alfred R. Guest
*Attorney, Agent, or Firm*—Paul J. Sutton

[57] ABSTRACT

The present invention teaches a novel, cushioned insole for footwear such as shoes, boots or the like. The insole comprises a multi-layered laminate that has a periphery which conforms generally to the shape of the inside surface of the sole of the footwear so that the insole may be readily placed in and removed from the footwear. The laminate preferably consists of a central, spongy core made of a foamed plastic material which is covered on its upper surface by a thin layer of generally fluid impervious plastic. The lower surface of the central core is covered with a thin layer of a fibrous material, such as paper. Three raised portions are provided which extend upwardly from the upper surface of the laminate. The first raised portion is located proximate the inner peripheral edge of the insole and extends generally longitudinally with respect thereto so as to provide support for the wearer's arch. The second raised portion is generally oval in shape with the major axis thereof extending longitudinally with respect to the insole and is placed such that it provides support for the wearer's metatarsis. The third raised portion extends generally transversely of the longitudinal axis of the insole and provides support for the wearer's phalanges. The laminate comprising the present invention is approximately 0.250 inches thick in the area thereof that is not raised, while the raised areas are not thicker than 0.375 inches. In the embodiment illustrated, the raised portion that supports the wearer's arch is the thickest while the raised portion that supports the wearer's phalanges is the thinnest of the three raised portions.

1 Claim, 3 Drawing Figures

CUSHIONED INSOLE FOR FOOTWEAR SUCH AS SHOES, BOOTS, OR THE LIKE

The present invention relates generally to footwear and more particularly to a novel, removable insole for shoes, boots or the like.

As is well known, the arch of a human foot is maintained by the shape of the bones, by the ligaments and by the muscles of the foot. Of these three, the muscles are thought by many to be the most important. All infants are born with flat arches. Frequently flat arches develop later in life. At an early stage of development, the flat foot may be flexible and may result from stretching of ligaments and weakening of muscles. At a later stage, the shape of the bones may be altered and the deformity may become rigid.

While little is known regarding the cause of flat feet, it is believed that the problem arises as a result of a disproportion between the weight that is to be borne and the muscles that must bear the weight. In some instances deformity follows an injury.

Flat feet are frequently treated by means which will secure the proper position of the arch. Frequently, special shoes are designed for a particular condition. Alternatively, supports may be fabricated which are rigid and which are removable from the footwear.

In a less extreme condition, or in those situations where the feet are not actually flat, it is frequently desirable to provide a removable support in order to place the bones in the proper position to thereby strengthen the muscles. It is also desirable to support the metatarsis and the phalanges of the foot.

The present invention provides an insole having a plurality of raised portions which constitute discrete areas that provide support for the arch, the metatarsis and the phalanges of a human foot. The insole comprising the present invention is made primarily of a spongy, resilient foam plastic material which is covered on its upper surface with a generally fluid impervious, thin plastic layer, and on its lower surface, by a fibrous material such as paper or the like. The insole comprising the present invention is extremely light in weight and is compressible so that it will not cause discomfort when being worn in a shoe, a boot or the like. Accordingly, it is an object of the present invention to provide an inexpensive, readily insertable and removable insole for a shoe, a boot or the like.

Another object of the present invention is to provide a novel insole having separate portions that support the arch, the metatarsis and the phalanges of a human foot when the insole is within a shoe, a boot or the like.

A further object of the present invention is to provide a novel insole, as described above, wherein the several supporting portions are raised above the surface of the remaining portion of the insole.

Yet another object of the present invention is to provide a novel insole for a shoe, a boot or the like, that may be made from relatively inexpensive materials.

An additional object of the present invention is to provide a novel insole, as described above, which may be fabricated using well-known techniques and readily available apparatus.

The present invention fulfills the above objects and overcomes limitations and disadvantages of prior art solutions to problems by providing, according to one aspect of the present invention, a novel combination of elements that form an insole for boots, shoes or the like. The novel insole of the present invention is comprised of a multi-layered laminate having a periphery that conforms generally to the shape of the inside surface of the sole of the footwear. First, second, and third raised portions are provided on the upper surface of the insole and are spaced from one another and are positioned so as to provide support for the wearer's arch, metatarsis and phalanges, respectively. The insole is made with a spongy central core of foamed plastic which is covered on its top surface by a generally fluid impervious thin plastic layer and on its bottom surface by a fibrour layer such as paper or the like. The non-raised portion of the insole is approximately 0.250 inches thick while the raised portion that supports the wearer's arch is approximately 0.375 inches thick. The remaining two raised portions are not thicker than the portion supporting the wearer's arch.

This invention will be more clearly understood from the following description of a specific embodiment of the invention, together with the accompanying drawing, wherein similar reference characters denote similar elements throughout the several views and in which.

Figure 1:
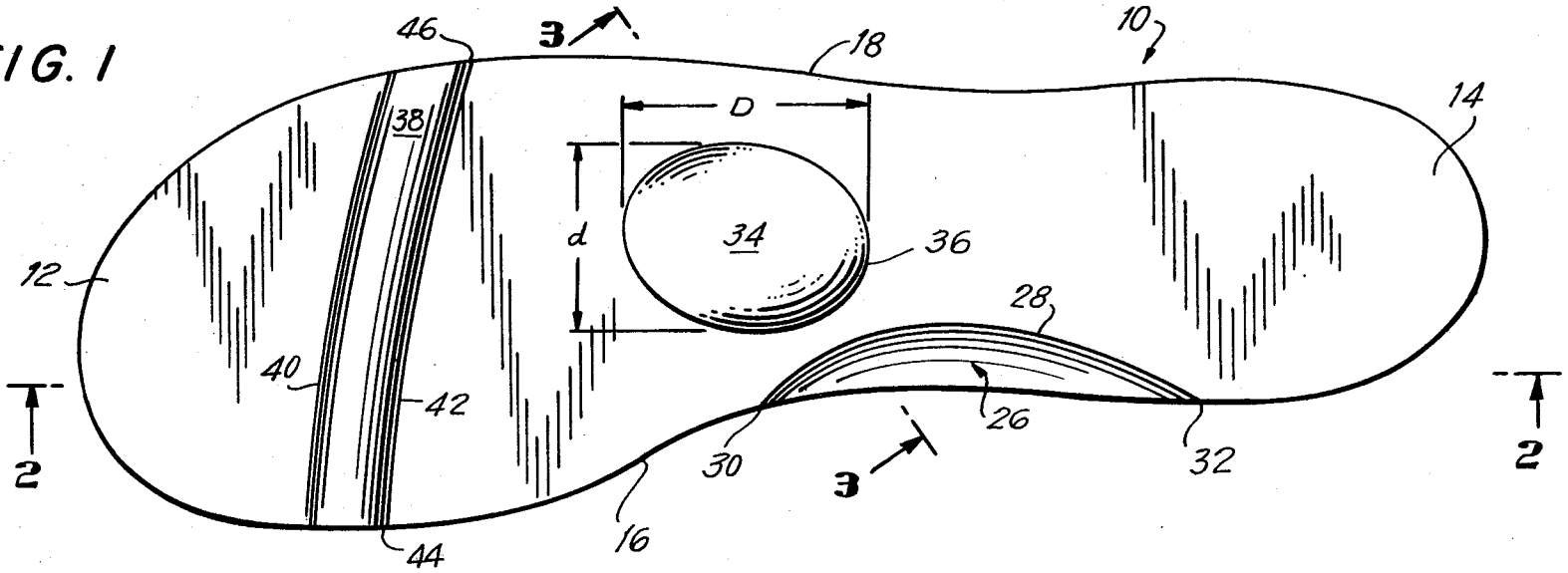
FIG. 1 is a plan view of the novel insole comprising the present invention.

Referring now in more detail to the drawing, there is shown in FIG. 1 a novel insole 10 comprising the present invention. The insole 10 includes a forward portion 12 that is adapted to support the wearer's phalanges and a rear portion 14 that is adapted to support the wearer's heel. As shown in FIG. 1, the insole is shaped for the user's right foot with the longitudinally extending peripheral edge designated by the reference character 16 being the inside peripheral edge, while the longitudinally extending peripheral edge designated by the reference character 18 represents the outside peripheral edge.

Figure 2:
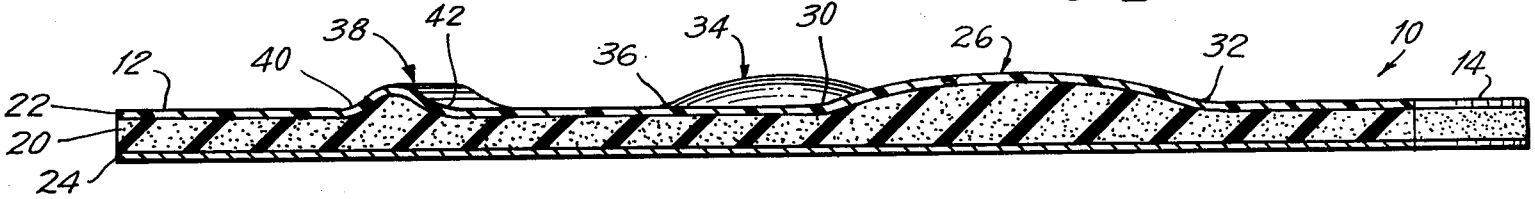
FIG. 2 is a longitudinal sectional elevational view taken along line 2—2 of FIG. 1.
Figure 3:
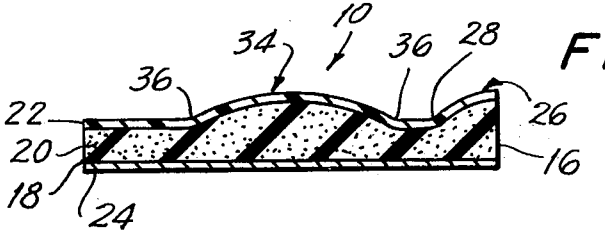
FIG. 3 is a generally transverse sectional elevational view taken along line 3—3 of FIG. 1.

The construction of the insole 10 may best be appreciated by reference to FIG. 2, wherein it will be seen that there is provided a central core or layer 20 made of any suitable spongy plastic material such as, but not limited to, polyurethane for example. Secured to the upper surface of the central layer 20 is a generally fluid impervious, thin layer of plastic 22 which may be, but which is not limited to, polyvinylchloride or the like. The lower surface of the central core 20 is covered by a thin fibrous layer 24 which may be made of, but is not limited to, paper or the like. The layers 22 and 24 may be secured to the central core 20 by any suitable adhesive means.

Referring once again to FIG. 1 it will be seen that there is a first raised portion generally designated by the reference character 26 which is positioned along the inside, peripheral edge 16 and which is defined by an arcuate line 28 that extends inwardly from and terminates at both ends at the inside peripheral edge 16. By way of example, and without intending to be limiting, the thickness of the raised portion 26 may be approximately 0.375 inches. The length of the raised portion 26, from its starting position at point 30 to its terminal position at point 32, may be approximately 2.750 inches. The starting position 30, in the embodiment illustrated, may be approximately 4.000 inches from the forwardmost end edge of the insole 10. It should be understood, however, that the foregoing dimensions are for purposes of illustration only and will vary depending upon the desired size of the insole 10.

Still referring to FIG. 1, there is also shown a second raised portion 34 which is bounded by an oval-shaped line 36. The second raised portion 34 supports the wearer's metatarsis and is positioned approximately at the midpoint of the insole and approximately on the longitudinal axis thereof. By way of example, and without intending to be limiting, the major dimension "D" may be approximately 1.500 inches while the minor dimension *d* may be approximately 1.250 inches.

A third raised portion 38 may also be seen by referring to FIG. 1. The third raised portion is defined by fore and aft, generally transverse lines 40 and 42 respectively, which extend between the opposed peripheral inside and outside edges 16 and 18, respectively. The third raised portion 38 is adapted to support the wearer's phalanges. As shown in FIG. 1, the lines 40 and 42 that define the third raised portion 38 may be slightly curved. As further shown in FIG. 1, the end of the third raised portion 38 that starts at the inside peripheral edge 16 is further forward than the end of the third raised portion 38 that starts at the outside peripheral edge 18. In the embodiment illustrated, the line 42 at point 44 is approximately 1.500 inches from the forwardmost end edge of the insole 10 while the point 46 on the line 42, which is on the outside peripheral edge 18, is approximately 0.500 inches rearward of the point 44. The raised portion 38 has a substantially uniform width throughout which, in the embodiment illustrated, is approximately 0.500 inches. It should be further noted that the forwardmost end of the second raised portion 34, is approximately 1.500 inches rearward of point 44 while point 30 of the first raised portion 26 is approximately 1.000 inches rearward of the forwardmost point of the second raised portion 34.

It will be appreciated from the foregoing that there has been provided a novel insole that may be readily inserted and removed from a shoe, a boot or the like. The novel insole of this invention is relatively inexpensive and may be made by readily available techniques and apparatus using well known, conventional and readily available materials. The insole of the present invention provides a laminate having a central spongy core which is covered on its upper surface by a generally fluid impervious plastic material and on its lower surface by a fibrous material. Three raised portions are provided on the insole for supporting the arch, the metatarsis and the phalanges of a human foot.

The embodiment of the invention, particularly disclosed here, is presented merely as an example of the invention. Other embodiments, forms and modifications of the invention, coming within the proper scope of the appended claims will, of course, readily suggest themselves to those skilled in the art.

What is claimed is:

1. A cushioned insole for use with footwear such as a shoe, a boot or the like, said insole comprising: a multilayered laminate having a periphery conforming generally to the shape of the inside surface of the sole of the footwear, a first raised portion extending upwardly from the upper surface of said laminate and located so as to provide support for the wearer's arch, a second raised portion extending generally upward from the upper surface of said laminate and located so as to provide support for the wearer's metatarsis, and a third raised portion extending upwardly from the upper surface of said laminate and located so as to provide support for all of the wearer's phalanges, said insole extending along a central longitudinal axis from a relatively narrow unraised heel portion starting at a rearward heel end, to an unraised arch mid-section thereof, thereafter to a gradually transversely wider unraised phalanges section, and ultimately to a forward to end, an outer edge of the insole along said wider phalanges section lying generally closer to said longitudinal axis than an inner edge opposite said outer edge, said first raised portion extending from said inner edge along said mid-section and said heel portion to points less than half the distance toward the outer edge, said second raised portion being spaced from said first raised portion and said outer and inner edges such that unraised mid-section surfaces are disposed therebetween, said second raised portion having a generally elliptical peripheral shape and being disposed substantially mid-length between said heel and toe ends, said third raised portion extending generally transversely entirely across said longitudinal axis and interconnecting said outer and inner edges at said phalanges section, said laminate being comprised of a spongy, central core layer, a thin plastic layer secured to the upper surface of said central layer and a thin layer of fibrous material secured to the lower surface of said central layer, and wherein the thickness of said first raised portion exceeds the thickness of said second and third raised portions.

* * * * *